US008925560B2

(12) United States Patent
Heiberg

(10) Patent No.: US 8,925,560 B2
(45) Date of Patent: Jan. 6, 2015

(54) COMB

(76) Inventor: Helle Heiberg, Ålsgårde (DK)

( * ) Notice: Subject to any disclaimer, the term of this patent is extended or adjusted under 35 U.S.C. 154(b) by 315 days.

(21) Appl. No.: 13/823,894

(22) PCT Filed: Sep. 15, 2010

(86) PCT No.: PCT/DK2010/050235
§ 371 (c)(1),
(2), (4) Date: Apr. 15, 2013

(87) PCT Pub. No.: WO2011/032562
PCT Pub. Date: Mar. 24, 2011

(65) Prior Publication Data

US 2014/0144455 A1 May 29, 2014

(30) Foreign Application Priority Data

Sep. 17, 2009 (DK) ..... 2009 01036

(51) Int. Cl.
*A45D 24/00* (2006.01)
*A45D 24/30* (2006.01)
*A45D 24/02* (2006.01)

(52) U.S. Cl.
CPC ..... *A45D 24/30* (2013.01); *A45D 24/02* (2013.01); *Y10S 132/901* (2013.01)
USPC ..... 132/219; 132/160; 132/161; 132/901

(58) Field of Classification Search
CPC ..... A45D 24/00; A45D 24/30; A45D 24/02; A45D 8/12; A45D 24/34; A45D 24/36; A01K 13/001; A01K 13/002
USPC ..... 132/219, 200, 212, 106, 107, 121, 125, 132/126, 141, 142, 150, 132, 156–161, 137, 132/138, 139, 273, 213.1, 55, 216–218, 132/901; 119/600, 602, 611, 612, 613, 615, 119/616, 617, 625, 626; D28/21, 22, 28, D28/29, 31, 32, 33, 74
See application file for complete search history.

(56) References Cited

U.S. PATENT DOCUMENTS

| | | | | | |
|---|---|---|---|---|---|
| 722,714 | A | * | 3/1903 | Kahn | 132/160 |
| 774,990 | A | * | 11/1904 | Newton | 132/106 |
| 794,828 | A | * | 7/1905 | Winn | 132/160 |
| 909,635 | A | * | 1/1909 | Moler | 132/158 |
| 1,025,156 | A | * | 5/1912 | Potter | 132/139 |
| 1,381,804 | A | * | 6/1921 | Crawford | 132/150 |
| 1,419,579 | A | * | 6/1922 | Moberry | 132/141 |
| 1,551,160 | A | * | 8/1925 | Laufe | 132/160 |
| 1,727,837 | A | * | 9/1929 | Miller et al. | 132/150 |
| 1,888,923 | A | * | 11/1932 | Jennison | 132/126 |
| 1,892,749 | A | * | 1/1933 | Philaja | 132/137 |

(Continued)

*Primary Examiner* — Vanitha Elgart
(74) *Attorney, Agent, or Firm* — Gifford, Krass, Sprinkle, Anderson & Citkowski, P.C.

(57) ABSTRACT

There is disclosed a comb. The comb has an upper or a basic part and a number of teeth attached to and pointing out from the upper or basic part, wherein the outer or free end of at least a portion of the teeth forms two curved shapes or curvatures for the touch of a scalp. The first curvature has a radius of curvature substantially perpendicular to the longitudinal direction of the teeth, and the second curvature is curved outwards in relation to the upper or basic part. The radius of curvature of the first curvature may be in the range of 3-14 cm.

13 Claims, 10 Drawing Sheets

(56) References Cited

U.S. PATENT DOCUMENTS

| | | | | | |
|---|---|---|---|---|---|
| 1,997,944 | A | * | 4/1935 | Ogden, Jr. et al. | 132/107 |
| 2,035,667 | A | * | 3/1936 | Payes et al. | 132/150 |
| 2,139,106 | A | * | 12/1938 | Solomon | 132/144 |
| 2,221,446 | A | * | 11/1940 | Evans | 132/154 |
| 2,348,339 | A | * | 5/1944 | Golden | 132/142 |
| 2,376,065 | A | * | 5/1945 | Kuszyk | 132/114 |
| 2,471,279 | A | | 5/1949 | Mensing | |
| D162,749 | S | * | 4/1951 | Polimeni | D28/28 |
| 2,596,296 | A | * | 5/1952 | Shields | 132/160 |
| 2,610,637 | A | * | 9/1952 | Fuentes | 132/120 |
| 2,755,808 | A | * | 7/1956 | Golden | 132/126 |
| 2,915,071 | A | * | 12/1959 | Watkins | 132/213.1 |
| 2,929,386 | A | * | 3/1960 | Behr et al. | 132/156 |
| D206,527 | S | * | 12/1966 | Montecalvo | D30/159 |
| 4,612,944 | A | * | 9/1986 | Bachrach et al. | 132/159 |
| 4,612,945 | A | * | 9/1986 | Bachrach | 132/137 |
| 4,807,652 | A | * | 2/1989 | Bachrach | 132/137 |
| D302,342 | S | * | 7/1989 | Holton | D28/22 |
| 4,867,184 | A | * | 9/1989 | Davis | 132/214 |
| 5,927,291 | A | * | 7/1999 | Beall | 132/144 |
| 5,927,295 | A | * | 7/1999 | Quinones | 132/216 |
| 6,050,272 | A | * | 4/2000 | Droin | 132/273 |
| 6,079,421 | A | * | 6/2000 | Tafoya | 132/213.1 |
| D495,089 | S | * | 8/2004 | Tomaro | D28/21 |
| 7,234,472 | B2 | * | 6/2007 | Ramet | 132/139 |
| 7,909,042 | B2 | * | 3/2011 | Bachrach et al. | 132/159 |
| 2009/0065017 | A1 | * | 3/2009 | Yoo | 132/216 |
| 2010/0300469 | A1 | * | 12/2010 | Bachrach et al. | 132/107 |
| 2012/0037176 | A1 | * | 2/2012 | Ito | 132/200 |

* cited by examiner

Fig. 7a
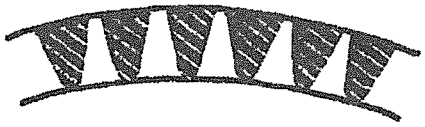
Fig. 7b
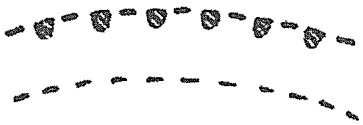
Fig. 7e
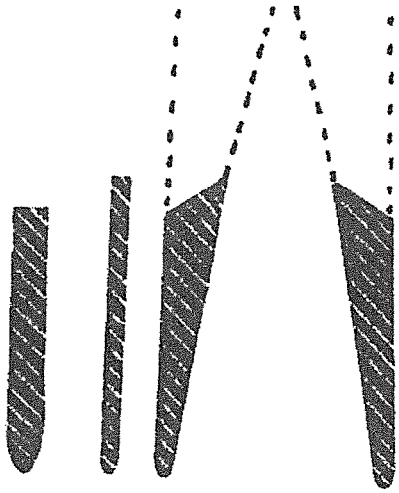
Fig. 7c
Fig. 7f
Fig. 7d
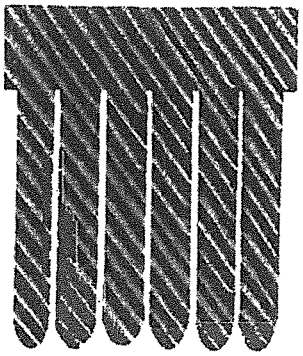
Fig. 7g
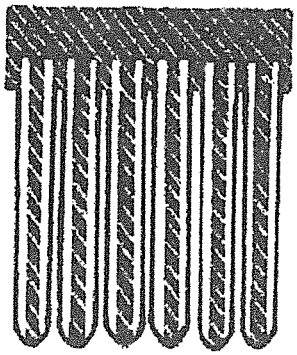
Fig. 7h

COMB

CROSS-REFERENCE TO RELATED APPLICATIONS

This application is the U.S. National Phase of PCT/DK2010/050235 filed Sep. 15, 2010.

FIELD OF INVENTION

This invention relates to a comb, which is curved. With the invention there is provided a comb for combing hair at the scalp of humans. The comb can be designed as a fine-toothed comb for combing of hair in order to remove lice and nits from the hair near the scalp. The comb can also be used in the treatment of psoriasis and for removing scurf and dandruff from the scalp. The comb can also in another design be used as a comb for combing all types of hair. Furthermore, the comb can be designed as a comb for holding the hair in place in a hair style. The comb may in different designs be used to massage the scalp. The comb can also be used two eliminate vermin from animals.

BACKGROUND OF THE INVENTION

Fine-toothed combs have long been known and used. The known fine-toothed combs are all designed with teeth, which are mounted on or molded into a straight piece. This right angle is not desirable since a human head is mainly round. With the known fine-toothed combs it is only a small section of the teeth, relative to the entire comb width, which affects the scalp. With the known fine-toothed combs then only a max of approx. 2 cm is combed at a time on the parts of the head which is round. With the known fine-toothed combs, combing often feels uncomfortable because the teeth are often sharp and because a relatively small area is affected during combing. The teeth on some of the fine-toothed combs made of steel feels like needles on the scalp. The handle on most known fine-toothed combs is flat and thin and not shaped to be held for a longer period of time.

The teeth on the known fine-toothed combs are of plastic or steel. The teeth of steel are round. For the plastic material the teeth are molded into a thinner flat shape. The grey color of steel is not appropriate because lice are close to having the same color and are therefore not well spotted with the color of steel as a background.

Here follows eleven issues regarding the function of the fine-toothed comb:

A fine-toothed comb aims to collect as many lice and nits as efficiently as possible (1) and as quickly as possible (2). Combing of hair is a time consuming job. It takes up to an hour to comb a thick, half long hair with the existing fine-toothed combs.

Lice reside mainly on the scalp or the hair near the scalp. Therefore it is important that the fine-toothed comb is designed in such a way that as much of the scalp as possible may be affected each time the comb is pulled through the hair (3). After finding lice, the fine-toothed comb is led through the hair many times. It is therefore important that the act is carried out as gently as possible and with as few combings as possible (4).

It is known and used to use a fine-toothed comb for removing scurf sitting on the scalp and for removing dandruff and for treatment of psoriasis in the scalp. It is therefore important that the act can be performed as gently as possible and with as few touches as possible (5).

Often combing is painful on the person's delicate scalp. Therefore, the teeth should be designed in such a way that the tips of the teeth irritate the scalp by a minimum (6).

One aspect of the function of the fine-toothed comb is that the handle/base portion is comfortable to hold on for a longer period. The grip must be good. With a good grip the user is motivated. (7).

The handle should fit the hands of different sizes (8).

It should be possible to use the comb or fine-toothed comb on heads of varying size and shape. (9)

Nits sit glued onto straws of hair at a distance of approx. 0.1-1.0 cm from the scalp. Adult lice have a length of 2-3 mm. The nits are approx. 0.8 mm. If the nits also are to be collected with a fine-toothed comb, the space between the comb teeth is required to be below 0.8 mm.

As the hair becomes harder to untangle the smaller the gap is between the teeth, there can be several sizes of fine-toothed combs with different gap between the teeth, for example a comb for nits and a comb for lice (10). The fine-toothed comb designed for nits will also collect lice. However, it depends on hair thickness, length and possible creasing if this is feasible.

It is known and used to use conditioner or oil in the hair so it becomes easier to comb. Conditioner and oil makes the hair smooth and makes it more difficult for lice to move. The handle or base portion of the comb may therefore be designed to give a good grip which anyone, both child and adult, can hold without effort, and without regard to whether there is conditioner alternative oil in the hair or not (11).

SUMMARY OF THE INVENTION

According to the present invention there is provided a comb, which may be used for combing hair, which comb comprises an upper or basic part and a number of teeth attached to and pointing out from this upper/basic part, characterized in that the outer or free end of at least a portion of the teeth forms a curved shape or curvature for the touch of a scalp.

The comb may have multiple functions, of which four are mentioned here:

1. The comb can be designed and proportioned as a fine-toothed comb for combing of hair from the scalp to remove lice, nymphs and/or nits.
2. The comb can be designed and proportioned as a comb for hair combing.
3. The comb can be designed and proportioned as a comb for holding the hair.
4. The comb can be designed and proportioned as a wellness-comb to massage the scalp.

With a comb or fine-toothed comb which is curved, the hair can be combed close to the scalp throughout the comb width.

Although the provided comb or fine-toothed comb is curved, it can still be used on a more straight surface, as on the sides of the head. It only requires that the user angles the comb to match.

In an embodiment the comb is characterized in that the portion of the upper/basic part, to which the teeth are attached, is curved or arched, whereby the teeth, which are pointing out from the upper part, form a curvature or curved shape.

According to an embodiment the comb or fine-toothed comb is characterized in that the curvature or curved shape formed by the teeth has a radius which is substantially perpendicular to the longitudinal direction of the teeth. This curvature or curved shape may be called the first curvature.

The invention also covers a comb or fine-toothed comb, where the tip or outer end of the teeth extending away from the upper/basic part forms a curvature or curved shape that is curved outwards in relation to the upper part. This curved or arched shape may be called the second curvature. The invention thus covers a comb where the teeth form two curvatures or curved shapes, where the first curvature has a radius of curvature substantially perpendicular to the longitudinal direction of the teeth, and where the second curvature is curved outwards in relation to the upper part.

The invention also covers a comb comprising an upper or basic part and a number of teeth attached to and pointing out from the upper/basic part, wherein the outer or free end of at least a portion of the teeth forms two curvatures or curved shapes for the touch of a scalp where the first curvature has a radius of curvature substantially perpendicular to the longitudinal direction of the teeth, and where the second curvature is curved outwards in relation to the upper or basic part. It is preferred that the radius of curvature of the first curvature is in the range of 3-14 cm. Preferably, then for the second curvature, the teeth reach furthest out at the middle of the comb. It is within an embodiment of the invention that the portion of the upper or basic part, to which the teeth are attached, is curved, whereby the teeth, which are pointing out from the upper or basic part, form the first curvature.

It is preferred that the radius of curvature of the first curved shape or curvature, which has a radius of curvature substantially perpendicular to the longitudinal direction of the teeth, is within the range of 3-10 cm, such as in the range of 3.5-8 cm or 4-8 cm or such as around 4 or 6 cm. However, the invention also covers combs, where the radius of curvature of the first curved or arched shape is within the range of 8-14 cm, such as in the range of 9-12 cm or such as about 10 or 11 cm.

It is preferred that the radius of curvature of the second curved shape or curvature, which is curved outwards in relation to the upper/basic part, is within in the range of 2-100 cm.

Here the radius of the second curvature or curved shape may be in the range of 3-8 cm, such as in the range of 3.5 to 6 cm, or such as about 4 cm. The invention also covers combs, where the radius of the second curvature that is curved outwards in relation to the upper (basic part, is within the range of 6-14 cm, such as in the range of 8-12 cm, or such as about 10 or 11 cm.

The invention also covers a comb or fine-toothed comb, where the teeth lie substantially in one and the same plane, and where the tip or outer end of the teeth extending away from the upper part forms a curved or arched shape that is curved inwards in relation to the upper part.

The invention covers combs with different designs of the basic part, as long as the radius of the first and second curvatures of the tip of the teeth are within the ranges stated herein.

According to one or more embodiments the upper part of the comb is thicker than the lower portion of the comb.

The invention covers combs or fine-toothed combs with different shaped teeth. Here, at least a part of the teeth may be shaped so that the teeth cross section has at least two edges, and so that adjacent teeth have edges that are opposite each other. Here, the teeth cross section may be shaped like a parallelogram or a rhomb.

A comb or fine-toothed comb according to the invention may also have teeth, where for at least a part of the teeth, the teeth cross section is shaped so that the thickness or width of the teeth is decreasing towards one side of the comb. Here, the thickness or width of the teeth may be descending into the inner direction of the curved shape or towards the back of the loin. Here, the teeth cross section may be shaped like a triangle.

The present invention covers combs or fine-toothed combs with different dimensions. Examples include that the height of the upper part to which the teeth are attached may be in the range of 3-7 cm, the width of the comb may be in the range of 3.5 to 8 cm, the teeth may have a length in the range of 1 to 4.5 cm, and the space between the teeth may be in the range of 0.1 to 2 mm, such as in the range of 0.1 to 1 mm.

Different materials can be used for a comb or fine-toothed comb according to the invention, but it is preferred that the upper part and the teeth are made of a relatively hard material such as a plastic material.

Here, five improvements are mentioned for the new comb or fine-toothed comb according to the invention in relation to existing fine-toothed combs:

With a comb with two curvatures there is provided a tool, which improves the efficiency (1) and the time consumption decreases significantly (2), as the entire width of the comb can touch the scalp. This is an improvement of minimum 100% compared to the known fine-toothed combs. Combing of hair and scalp becomes a good experience, rather than a painful and frustrating experience—as with the existing fine-toothed combs—both for the person who is being combed and the person serving the comb, as the teeth of the comb stroke over the scalp at an oblique angle (3) (FIG. 6). The blood circulation in the scalp is stimulated giving a massaging and soothing effect (4). With the teeth of the new design (FIGS. 3 *a*-3 *h*), collection is made easier and more gentle (5) than with the known fine-toothed combs.

BRIEF DESCRIPTION OF THE DRAWINGS

FIGS. 7*a*-7*h* show a second embodiment of the teeth of a comb according to the invention.

DETAILED DESCRIPTION OF THE INVENTION

Figure 1A:
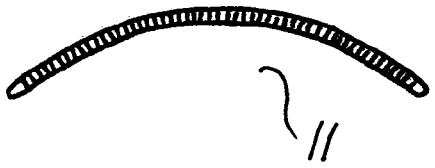
FIGS. 1*a*-1*d* show combs with a single curvature according to an embodiment of the invention.
Figure 1B:
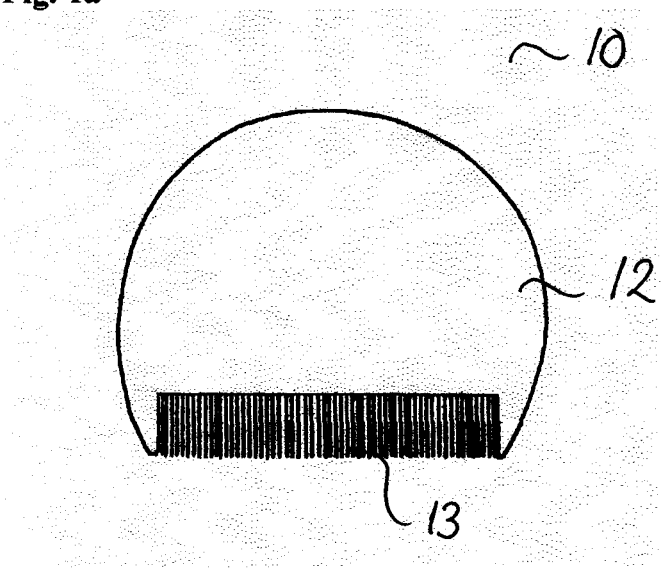
Figure 1C:
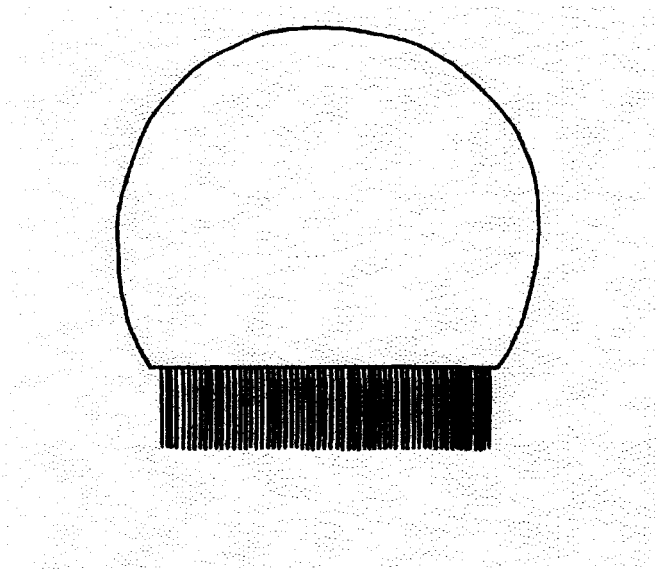
Figure 1D:
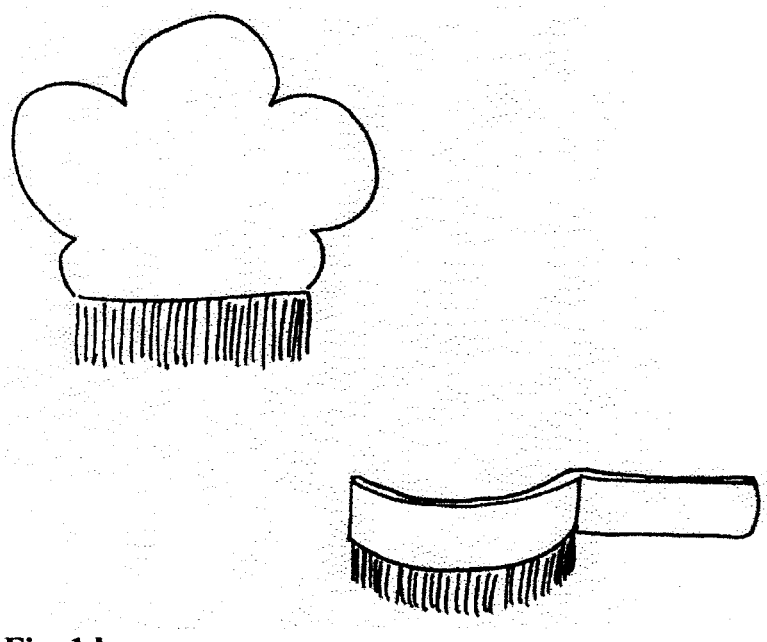

In FIGS. 1*a* and 1*b* a comb or a fine-toothed comb 10 is shown with a single curvature 11, according to an embodiment of the invention. The comb in FIGS. 1*a* and 1*b* has an upper or basic part 12 and a number of teeth 13 attached to and pointing out from the upper or basic part 12, and the outer or free end of the teeth 13 forms a curved shape or curvature 11 for the touch of a scalp. In FIG. 1*a* the comb 10 is seen from the end where the teeth 13 are pointing out, and it appears that the curvature 11 is essentially perpendicular to the longitudinal direction of the teeth 13. For the comb shown in FIG. 1*a* the radius of curvature is about 4 cm. FIGS. 1*b*, 1*c* and 1*d* show examples of curved combs, which has a curvature as shown in FIG. 1*a*, but where there are different handles or upper/basic parts of the combs.

Figure 2A:
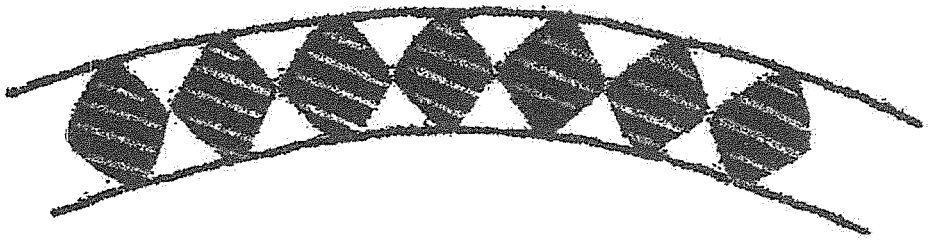
FIGS. 2*a*, 2*b* show a first embodiment of the teeth of a comb according to the invention.
Figure 2B:
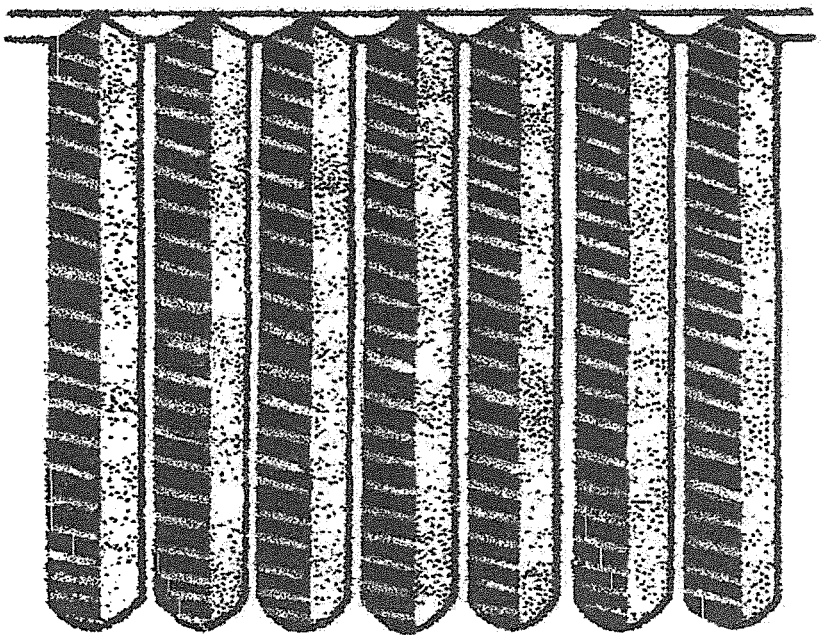

FIG. 2*a* shows an embodiment of the teeth 13 on the curved comb shown 10 in FIG. 1*a*. These teeth 13 may also be used for the combs shown in FIGS. 4 and 5. Here, the cross-section of the teeth 13 is formed as a rhomb, which improves the ability to capture the lice and/or nits. FIG. 2*b* shows the rhomb formed teeth shown from the side, and it appears that for the teeth of the shown embodiment are rounded at the tips.

Figure 3:
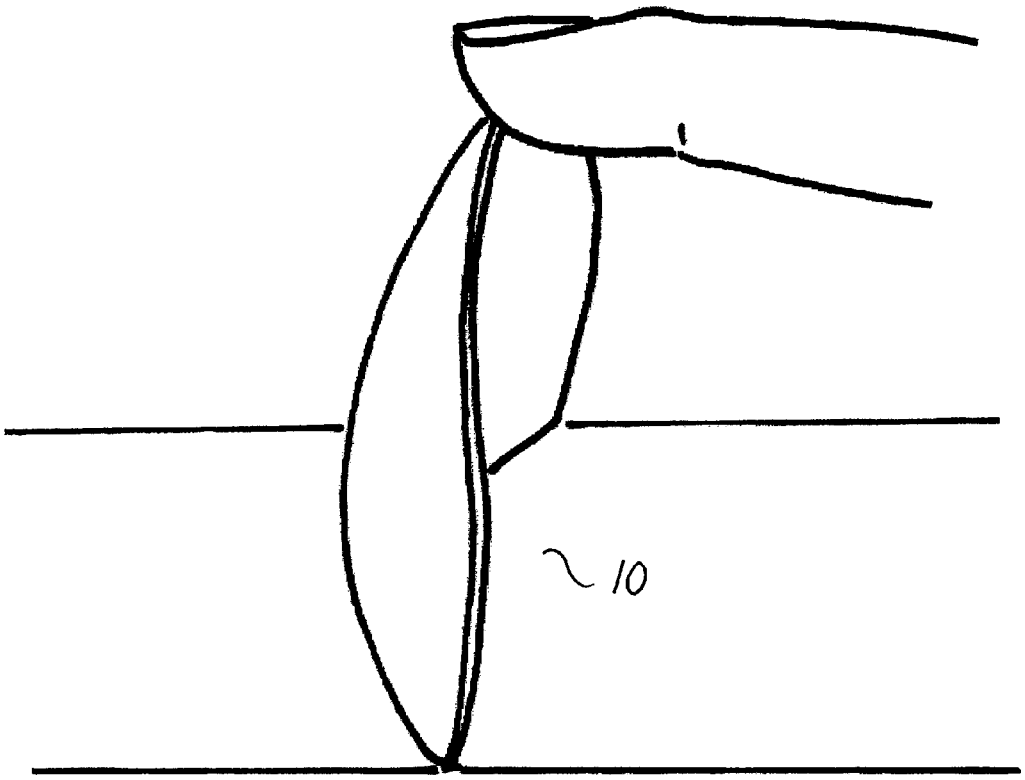
FIG. 3 shows a principle model of a comb with a single curvature according to an embodiment of the invention.

FIG. 3 shows a principle model of the curved comb or fine-toothed comb 10 shown in FIG. 1*a*. In FIG. 3 the model is shown obliquely from the side.

Figure 4A:
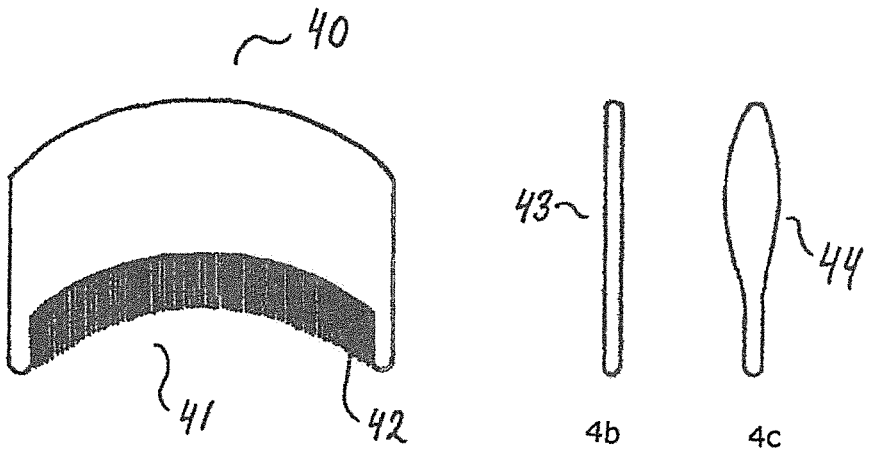
FIG. 4 shows a comb with a single curvature in which the teeth are in one plane according to an embodiment of the invention.

FIGS. 4*a*, 4*b*, and 4*c* show a comb or fine-toothed comb 40 with a single curvature 41 in which the teeth 42 are in one plane, according to an embodiment of the invention. The teeth 42 are in the same plane, and if the handle 43 is relatively thin (A) the comb 40 is flat. The comb 40 can also have a thicker handle 44 (B), so it is easier to hold.

As it appears from the examples shown in FIGS. 1 and 4 of combs 10, 40 according to the invention, then there may be different heights of the handle or the upper/basic part of the comb 10, 40. But it is preferred that the height of the upper/basic part to which the teeth are attached is in the range of 3-7 cm. The width of the comb 10, 40 can also vary, but it is preferred that the width ranges from 3.5 to 8 cm, or about 6 cm. The teeth 13, 42 should have a length so they are able to pick up nits and/or lice, and it is preferred that the length of the teeth 13, 42 is in the range of 1 to 4 cm, or in the range of 2-3 cm. The distance or gap between the teeth 13, 42 may also have a size suitable for collecting lice and/or nits, and here it is preferred that the space between the teeth ranges from 0.1 to 1 mm. The teeth 13, 42 can have a thickness or width of 0.8 mm-1.2 mm.

Figure 5A:
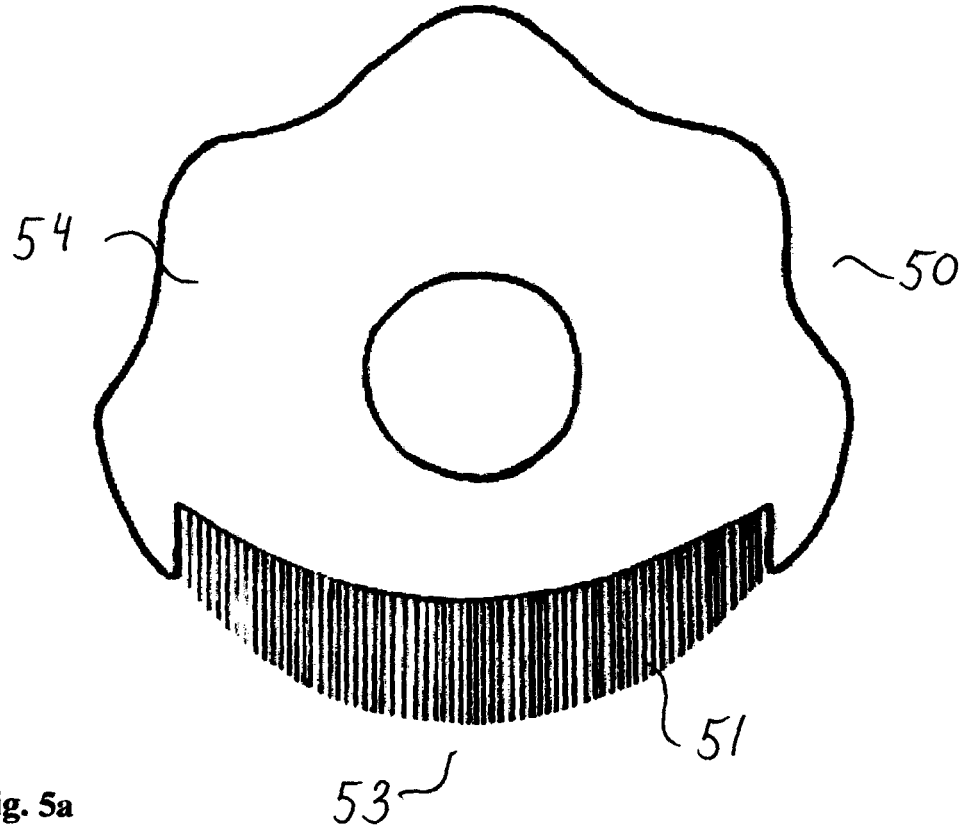
FIGS. 5*a*, 5*b* show a first example of a comb with two curvatures according to an embodiment of the invention.
Figure 5B:
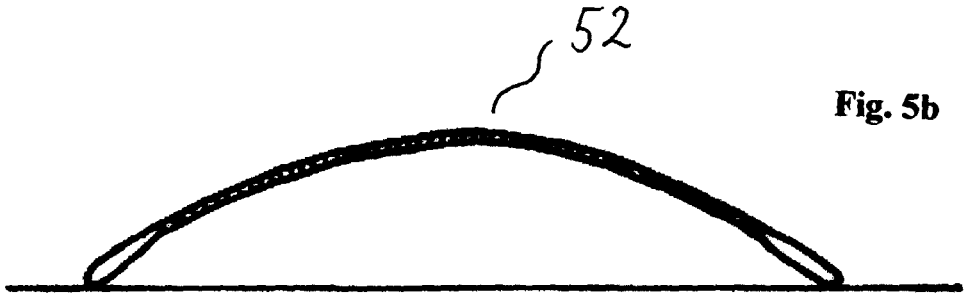

FIGS. 5*a*, 5*b* show a first example of a comb or fine-toothed comb 50, where the teeth 51 form two curved shapes or curvatures, where the first curved shape or curvature 52 has a radius of curvature substantially perpendicular to the longitudinal direction of the teeth 51, and where the second curved shape or curvature 53 is curved outwards in relation to the upper/basic part 54. The comb 50 of FIGS. 5*a* and 5*b* has an upper/basic part 54 and a number of teeth 51 attached to and pointing out from the upper/basic part 54. FIG. 5*b* shows the comb 50 as seen from the end where the teeth 51 point out, and shows the first curved shape or curvature 52 having a radius of curvature substantially perpendicular to the longitudinal direction of the teeth 51. FIG. 5*a* shows the comb 50 as seen from above and shows the other curved shape or curvature 53, where the outer or free end of the teeth 51 form a curved shape or curvature 53 that is curved outwards in relation to the upper/basic part 54.

Together, the two curvatures 52, 53 of the comb 50 of FIGS. 5*a* and 5*b* represent a new principle within combing and generally a new design of combs at all. The first curvature 52, FIG. 5*b*, makes the comb 50 following the head shape, and the second curvature 53, FIG. 5*a*, provides gradual introduction of the comb teeth through the hair.

For the comb 50 shown in FIG. 5*b*, the radius of curvature of the first curvature or curved shape 52 is in the range of 4-8 cm, and it is preferred that it is 6 cm. For the comb 50 shown in FIG. 5*a*, the radius of curvature of the second curvature 53 is in the range of 3-5 cm, with about 4 cm being preferred. The width of the comb 50 in FIGS. 5*a* and 5*b* is about 9 cm and the height is approx. 7.5 cm. For the comb 50 in FIGS. 5*a* and 5*b*, the teeth 51 have a width of approx. 0.8 mm and the spacing between the teeth 51 is about 0.2 mm, when the comb is viewed from the top. The teeth 51 are either rounded or angular. The number of teeth is between 40-90, with about 75 being preferred. This means that the piece 54 holding the teeth has a width of about 7.5 cm. The length of the teeth 51 is between 0.8-1.3 cm, where the middle teeth are the longest. Depending on the design, the length of the teeth 51 can be up to 2.5 cm and instead of having different length for the teeth 51 of a comb, all the teeth 51 may have the same length.

The new technique for combing may, particularly for long and/or filtered hair, be implemented as a two-step combing, in which the first combing is with a larger comb, followed by a combing with a smaller comb, where the smaller comb can be sized as described above in connection with FIGS. 5*a* and 5*b*, and where the larger comb can be sized as described and shown below in FIGS. 6*a* and 6*b*.

Figure 6A:
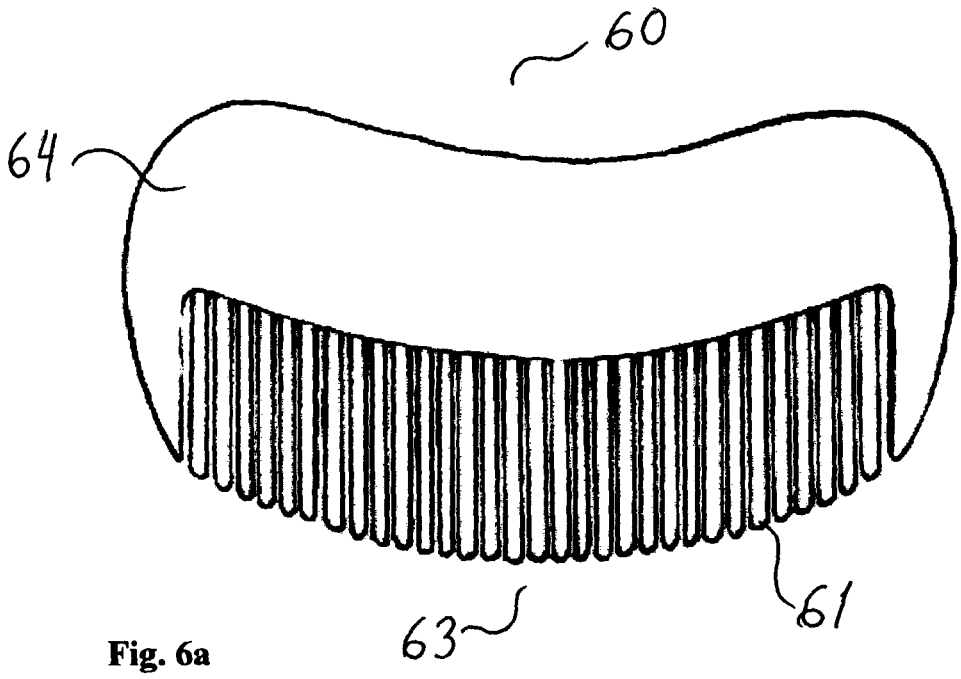
FIGS. 6*a*, 6*b* show a second example of a comb with two curvatures according to an embodiment of the invention.
Figure 6B:
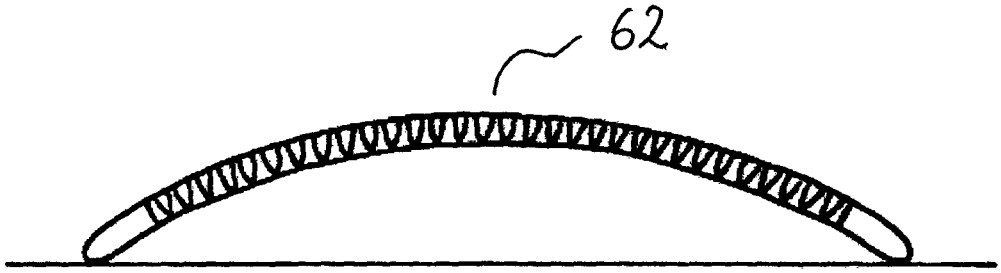

FIGS. 6*a*, 6*b* show a second example of a comb 60 with two curvatures 62, 63, where the first curved shape or curvature 62 has a radius of curvature essentially perpendicular to the longitudinal direction of the teeth 61, and where the second curved shape or curvature 63 is curved outwards in relation to the upper/basic part 64. Also for the comb 60 in FIGS. 6*a* and 6*b* it applies that it has an upper/basic part 64 and a number of teeth 61 attached to and pointing out from the upper/basic part 64. FIG. 6*b* shows the comb 60 as seen from the end where the teeth 61 are pointing out and shows the first curved shape or curvature 62, which has a curvature substantially perpendicular to the longitudinal direction of the teeth 61, and FIG. 6*a* shows the comb 60 as seen from above and shows the second curved shape or curvature 63, where the outer or free end of the teeth 61 is forming a curved shape or curvature 63 that is curved outwards in relation to the upper/basic part 64.

For the comb 60 shown in FIG. 6*b*, the radius of curvature of the first curvature or curved shape 62 is in the range of 8-11 cm, and it is preferred that it is 10 cm. For the comb 60 shown in FIG. 6*a*, the second curvature 63 has a radius of curvature in the range of 9-12 cm with 10-11 cm being preferred. The width of the comb 60 in FIGS. 6*a* and 6*b* is in the range of 8-12 cm and the height is in the range of 5-8 cm. For the comb 60 in FIGS. 6*a* and 6*b*, the teeth 61 have a width of approx. 2 mm and the space between the teeth 61 is about 1 mm, when the comb 60 is viewed from the top. The teeth 61 are either rounded or angled. The number of teeth 61 is between 20-40, with about 30 being preferred. Depending on the design, the length of the teeth 61 is between 2.5-4.5 cm.

FIGS. 7*a*-7*h* show a second embodiment for the teeth of a comb or fine-toothed comb according to the invention. Here, the cross section of the teeth is shaped so that the width or thickness of the teeth is decreasing in the inner direction of the first curved shape or from the front to the back of the comb. Furthermore, the side width of the teeth is decreasing longitudinally from the handle or the upper/basic part to the outer tip of the teeth. This is shown in FIGS. 7*a*-7*f*, where FIG. 7*a* shows a cross section of the teeth just below the upper part or handle, and FIG. 7*b* shows the outer tip of the teeth as seen from the bottom of the comb. A single tooth is shown in FIGS. 7*c*-7*f*, where FIG. 7*c* shows the tooth from the front of the comb, FIG. 7*d* shows the tooth from the back of the comb, FIG. 7*e* shows the tooth viewed from one side, and FIG. 7*f* shows the tooth viewed from the other side. It is seen that the tooth cross-sectional area decreases longitudinally from the handle to the tip of the tooth as the side width decreases. It is also seen that the width or thickness decreases from the front towards the back of the comb. Furthermore, the teeth are rounded at the tips.

The width of the front of the tooth is substantially constant until the bottom piece of the tooth, which appears from FIG. 7*g*, which shows a segment of a comb with teeth viewed from the front, and FIG. 7*h*, which shows the same segment viewed from the back of the comb. The teeth are shaped thin at the tip, to best reach down to the scalp through the hair. The teeth become wider at the handle and the strength of each tooth is hereby improved.

The teeth shown in FIGS. 7*a*-7*h* may have a cross section that is shaped like a triangle, where the front has a constant width, while the two side widths decrease in the longitudinal direction of the teeth.

Figure 8:
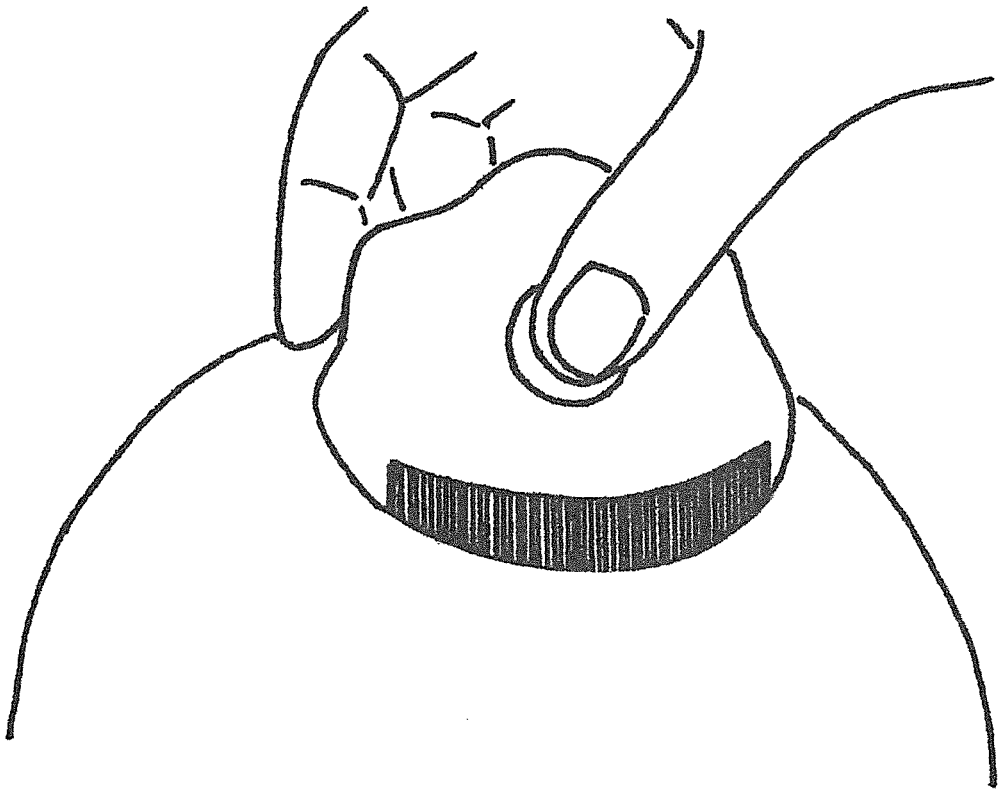
FIG. 8 illustrates combing on a curved surface with a comb according to an embodiment of the invention.
Figure 9:
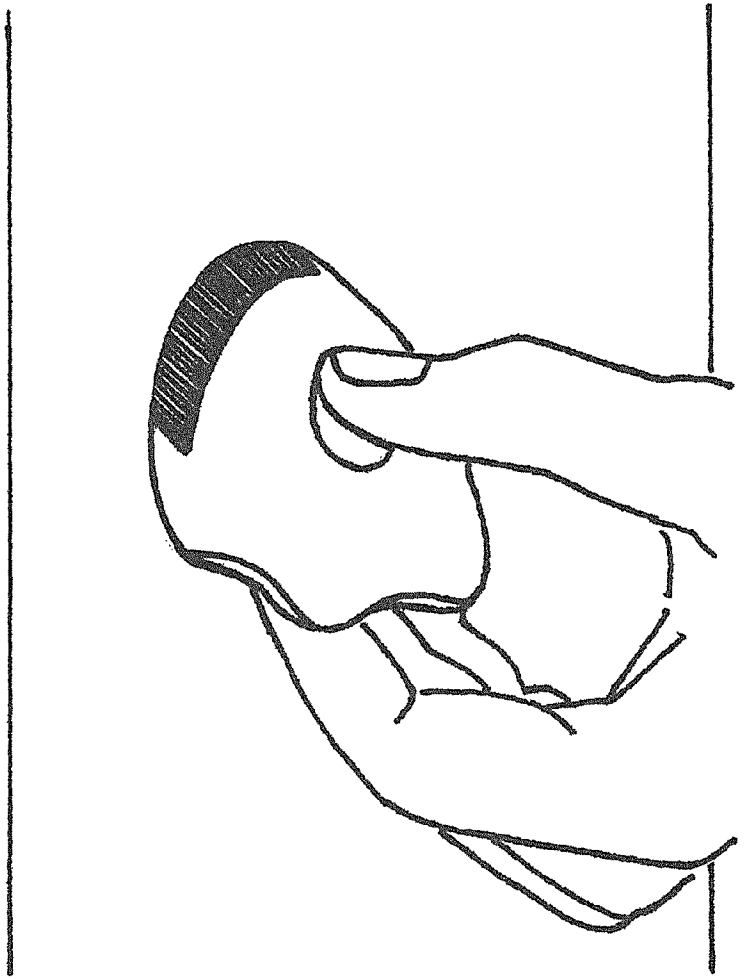
FIG. 9 illustrates combing on a flat surface with a comb according to an embodiment of the invention.

FIG. 8 illustrates combing on a curved surface, which may be the top of the head and the back of the head of a person, with a comb according to an embodiment of the invention, and FIG. 9 illustrates combing on a substantially plane surface, which may be the side of the head of a person.

The teeth on a fine-toothed comb must have a length so they are able to reach the scalp through the hair and it is preferred that the length is in the range of 1-4 cm, or in the range of 1-2 cm. The distance between the teeth on a fine-toothed comb must have a size suitable for collecting lice and/or nits, and here it is preferred that the distance between the teeth is in the range of 0.1-0.3 mm or 0.2 mm. The teeth can have a thickness or width of 0.8-1.2 mm.

The total width of the row of teeth depends on the purpose for which the comb is to be used. The width of the row of teeth for a fine-toothed comb according to an embodiment of the invention may be in the range of 5-8 cm, and the width of the row of teeth for a comb for combing hair may be in the range of 5-10 cm.

In an embodiment of the comb, both the upper part and the teeth are made of a relatively rigid plastic material. Thus, both the upper/basic part, the handle, and teeth may be made of a plastic material, but a different combination of materials may also be used. Here the upper/basic part, the handle, may be made of plastic while the teeth may be made of a metal. The invention also covers a combination in which the handle is a rubber material and the teeth are made of metal or plastic. Other possible materials include melanin and bamboo.

The Technical Effect

With a comb that curves, the function of the comb as a fine-toothed comb is more effective in that in can be used along the entire edge of the comb, whereby all teeth of the comb can meet the scalp on both round and straight surfaces, see FIGS. 8 and 9, and if the width of the comb is 6 cm, then lice and nits can efficiently be collected at 6 cm.

Lice and nits are thus collected, every time the hair is combed, on a much larger area than previously known. This also means that the time spent by combing is substantially reduced.

It also means that the number of combings through the hair from the scalp can be reduced.

This leads to the result that many unnecessary contacts with the scalp can be avoided whereby the scalp will be less sore and irritated.

The advantage of the first curvature is that the curves of the head as well as the straight surfaces can be contacted along the total width of the row of teeth. The advantage of the second curvature is: 1) Gradual introduction of the teeth where one starts by putting the outer teeth down through the hair, catches a hold and then angles the handle down toward the scalp while combing the hair. 2) When combing, the comb gets an angle which causes the teeth to be introduced obliquely against the scalp, so the action feels comfortable on the recipient. In addition to making combing easier, the design of the comb allows all teeth to be used each time the hair is combed through. With this comb there is also the option of using only the outer part of the teeth. Thus, the principles of the two curvatures together create a user-friendly, flexible tool which can be used on different head sizes and shapes.

According to an embodiment of the invention, the teeth have a new edgy design, see FIGS. 2*a* and 2*b*. The fact that the teeth have this angular design makes collection easier than for the known shapes of teeth, since there with this design is formed a triangular cavity in which the louse or the egg can lie. The rounded peaks of the teeth make combing less painful.

Depending on the thickness, length and nature of the hair, it can sometimes be difficult to lead the comb, having only the first curvature 11, through the hair in one step. Therefore, a comb 50, 60 with two curvatures 52, 62, 53, 63 is introduced, where the second curvature 53, 63 provides for the gradual introduction of teeth: one start by putting the outer teeth down, to obtain a grip and then angles the handle down towards the scalp while combing the hair. In addition to making combing easier, the design of the comb makes it possible for all teeth to be used each time the hair is combed. This comb 50, 60 also gives the option of using only the outer part of the teeth. The principles of the two curvatures 52, 62, 53, 63 thus create a user-friendly, flexible tool.

Lice and nits are found mainly close to the scalp. With a fine-toothed comb, which is curved, it is thus made possible to comb on a much larger area and much faster than before. In addition, many unnecessary touches with the scalp are avoided, where the scalp may otherwise become sore and irritated.

Therefore, this produced comb or fine-toothed comb is formed to follow the shape of the head. A nit sits glued onto a stray of hair at a distance of approximately 0.1-1.0 cm from the scalp. Nits are thus also easier removed with this product than with the known fine-toothed combs.

The invention claimed is:

1. A comb comprising an upper or a basic part and a number of teeth attached to and pointing out from the upper or basic part each of, said teeth having a or free end and a length that form respective convex segments of the comb, wherein at least a part of the length of the teeth forms a first curvature that is substantially perpendicular to a longitudinal direction of said teeth, said first curvature being a sector of a circle having a radius of curvature in the range of 3-14 cm, and the free ends of the teeth form a second curvature at an outward projection of the teeth to a plane normal to the upper or basic part, said second curvature being a sector of a circle having a radius of curvature in the range of 3-14 cm.

2. A comb according to claim 1, wherein for at least a part of the teeth, the teeth cross section is shaped so that the thickness or width of the teeth is decreasing towards one side of the comb.

3. A comb according to claim 2, wherein the thickness or width of the teeth is decreasing in the inner direction of the first curved shape or from the front to the back of the comb.

4. A comb according to claim 1, wherein the teeth are rounded at the free ends.

5. A comb according to claim 1, wherein for at least a part of the teeth, the teeth cross section has at least two edges, so that adjacent teeth have edges that are opposite each other.

6. A comb according to claim 5, wherein the teeth cross section is shaped like a parallelogram or a rhomb.

7. A comb according to claim 6, wherein the teeth are rounded at the free ends.

8. A comb according to claim 1, wherein the tooth in the middle of the comb is the longest tooth.

9. A comb according to claim 1, wherein the portion of the upper or basic part, to which the teeth are attached, is curved.

10. A comb according to claim 1, wherein the radius of curvature of the first curvature is in the range of 4-8 cm.

11. A comb according to claim 1, wherein the radius of curvature of the first curvature is in the range of 8-14 cm.

12. A comb according to claim 1, wherein the radius of curvature of the second curvature is in the range of 3-8 cm.

13. A comb according to claim 1, wheron the radius of curvature of the second curvature is in the range of 6-14 cm.

* * * * *